US006793041B1

(12) United States Patent
Taylor

(10) Patent No.: US 6,793,041 B1
(45) Date of Patent: Sep. 21, 2004

(54) LADDER LEVELING DEVICE

(76) Inventor: Tony V. Taylor, 3564 Christmasville Rd., Oakfield, TN (US) 38362

( * ) Notice: Subject to any disclaimer, the term of this patent is extended or adjusted under 35 U.S.C. 154(b) by 0 days.

(21) Appl. No.: 10/359,779

(22) Filed: Feb. 7, 2003

(51) Int. Cl.[7] ..... E06C 1/00; E06C 7/16; E04G 1/00

(52) U.S. Cl. ..... 182/200; 182/129; 182/121

(58) Field of Search ..... 182/129, 200, 182/121, 45, 230, 111; 248/210, 238, 237, 188.2, 188.1; 254/104

(56) References Cited

U.S. PATENT DOCUMENTS 4,776,548 A * 10/1988 Bezenek ..... 248/188.2
4,830,320 A * 5/1989 Bellows ..... 248/188.2
5,249,767 A * 10/1993 Mellen ..... 248/188.2
5,339,921 A * 8/1994 Faupel ..... 182/200
5,461,752 A * 10/1995 Lemon et al. ..... 248/238
5,568,785 A * 10/1996 Hazen ..... 52/103
5,791,438 A * 8/1998 Kempton ..... 182/200
6,120,874 A * 9/2000 Shorten ..... 428/92
6,164,608 A * 12/2000 Schiel, Jr. ..... 248/188.2
6,313,549 B1 * 11/2001 Moisan et al. ..... 52/174

* cited by examiner

*Primary Examiner*—Hugh B. Thompson, II
(74) *Attorney, Agent, or Firm*—Wyatt, Tarrant & Combs, LLP

(57) ABSTRACT

A device for leveling a ladder on unlevel or uneven surfaces that includes a wedge shaped support member and features for safely retaining a ladder on a sloped top surface of the support member. Features include a rail, a slip resistant coating on the top surface, and a slip resistant tread on a bottom surface, the tread having a plurality of ribs. To prevent sliding on hard surfaces, the rubber grip tread preferably consists of a hard, substantially nonresilient rubber. To prevent sliding on soft surfaces, the device has a pair of retaining member bores and retaining members. Retaining member storage bores prevent the retaining members from being lost. A finger hold assists in removing the retaining members from a support surface. A ladder hanger bore assists in storing and transporting the device. Imprinted indicia prevent misuse of the device.

20 Claims, 5 Drawing Sheets

FIG. 1
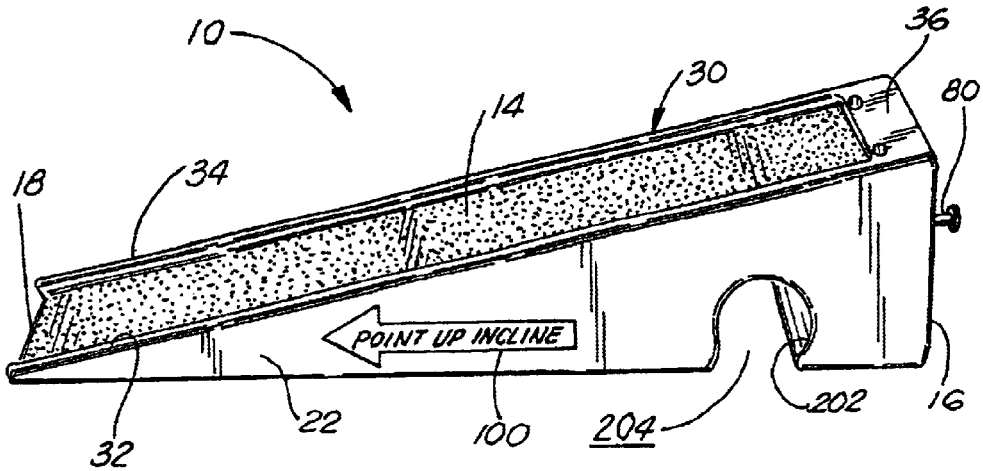
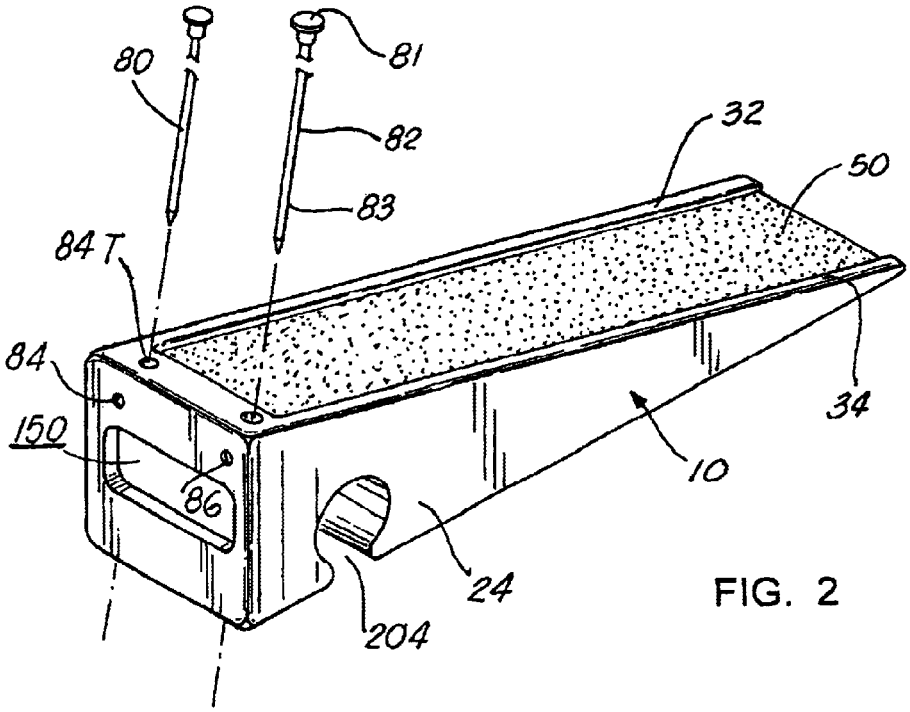
FIG. 2

LADDER LEVELING DEVICE

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A MICROFICHE APPENDIX

Not applicable

FIELD OF THE INVENTION

The present invention relates to devices for leveling ladders, and more particularly to the use of wedge shaped members for leveling ladders.

BACKGROUND OF THE INVENTION

A conventional extension ladder consists of a pair of lengthwise support legs, or stiles, that are joined together in a generally parallel relationship by a plurality of rungs. During use, an extension ladder is leaned against an external object, such as a wall or the side of a roof, for support. A step ladder is similar to an extension ladder, but it is provided with a second pair of support legs. The second pair of support legs make the ladder self-standing, such that it does not have to be leaned against an external object for support. During use, the rungs of a ladder are preferably kept in a horizontal orientation so as to provide secure and consistent footing for the user of the ladder and also keep the ladder vertically oriented. When a ladder is set up on an unlevel or uneven surface, such as a slopping hill, an inclined walkway, or bumpy ground, the ladder leans toward the downward slope, which typically results in a dangerous condition, given that the weight on the ladder is not centered directly over the base, i.e., centrally of the two legs. This non-centered placement generates a lateral force which tends to cause the ladder to rotate in that direction, leading potentially to a fall.

A ladder can be maintained in a substantially vertical orientation on a sloped surface by placing an object under the vertical legs of the ladder so as to counter the slope of the surface. Commonly available objects, such as boards, bricks and the like, are conventionally used for this purpose. However, because these items are not specifically designed for leveling a ladder, they are often difficult to use effectively. For example, it may be difficult to find an object of the required height for leveling the ladder on a particular slope. The use of boards, bricks and the like to level ladders may also lead to dangerous situations. For example, a ladder may slip off of a board or a brick may crumble during use, causing the ladder to fall.

In addition to common household items, various efforts have been made to design leveling devices that are specifically configured for leveling a ladder. See e.g. U.S. Pat. No. 5,339,921 (Faupel); U.S. Pat. No. 5,263,551 (Andersen); U.S. Pat. No. 5,139,109 (Clarke); U.S. Pat. No. 4,699,247 (Clarke).

The use of wedge shaped members to level ladders is known in the art. See e.g U.S. Patent 4,304,318 (Webb); U.S. Pat. No. 3,993,275(Lucas). For purposes of leveling ladders, wedges are superior to flat objects such as boards and bricks.

The triangular profile of a wedge allows the wedge to be inserted under a support leg of a ladder until the leg has been raised to a desired height. This feature allows the rungs of the ladder to be leveled with precision, preventing accidents. Additionally, one wedge can be used to level a ladder along various angles of slope simply by using higher or lower regions of the wedge.

One drawback of wedges is that they have a sloped surface, which can allow a ladder to slip down the wedge, resulting in a dangerous condition. Additionally, the use of a sloped upper surface allows the force transmitted through the leg of the ladder to be applied in a partially lateral direction, which may cause the bottom surface of the wedge to slide relative to the support surface, resulting in a dangerous condition.

U.S. Pat. No. 6,164,608 (Schiel, Jr.) discloses a ladder leveling chock system that consists of a pair of wedge shaped members. Each block has top and bottom faces, an end face, and a pair of side faces. The top and bottom faces converge together at an end vertex extending between the side faces and opposite the end face. The bottom face has a resiliently deformable surface. The top face is designed for resting a lower end of a rail of a ladder thereon, and has a resiliently deformable gripping strip coupled thereto for frictionally enhancing contact between the top face and the lower end of the upright a ladder. The chocks are used to provide a stable and generally horizontal surface for resting a ladder on sloped resting surfaces. The lower end of one of the support legs of a ladder is rested on the gripping strip of the top face of the first leveling chock, while the lower end of the other leg of the ladder is rested on the gripping strip of the top face of the second leveling chock.

Schiel discloses the use of a generally rectangular depression extending between the end vertex and the end face of the top surface. The depression has side walls that preferably lie in planes substantially parallel to the side faces. A generally resiliently deformable gripping strip substantially occupies the space defined by the depression. The gripping strip has a plurality of substantially parallel gripping ridges extending between the end face and the end vertex substantially parallel to the side faces. The resiliently deformable surface of the bottom face has a plurality of substantially parallel gripping ridges extending between the side faces substantially parallel to the end face. The depression and the gripping strip are preferably centered on the top face between the side faces and occupy an area between about one quarter and about three quarters of the total area of the top face in order to center the lower end of the rail on the top face for optimizing the stability of the lower end of the rail on the block. Ideally, the depression and the gripping strip occupy about one-half of the total area of the top face. Schiel also discloses a carrying cavity for receiving fingers of a user therein to aid in carrying of the block.

U.S. Pat. No. 3,993,275 (Lucas) discloses a ladder lifting and leveling device that includes both a series of steps and an inclined plane that are part of a unitary body and are separated by a brace or ridge. Lucas discloses providing a brace or ridge on an outer edge of the inclined plane to prevent slippage of a ladder.

There is a need for a device for level ladders having the following characteristics and advantages over the prior art.

OBJECTS AND SUMMARY OF THE INVENTION

It is an objective of the invention to provide a device for leveling an OSHA-approved ladder on non-level or uneven surfaces that is easy to use, and that includes safety features for securing a ladder in place on the device and for enhancing the overall stability of the ladder. An OSHA-approved ladder is one which has pivoted feet on the bottom of the ladder side rails, such that on placement of the ladder on a surface, the feet rotate so as to be flat against the surface upon which the ladder is set, assuring as much of a secure placement as the local surface allows.

The device includes a wedge-shaped support member having a lengthwise dimension, a planar top surface, and a planar bottom surface. The top surface of the support member tapers downward from an elevated rear end to a narrow front vertex to thereby form an acute angle between the top surface and the bottom surface. A rear rail member and a pair of opposing side rail members provide a barrier for retaining the end of a ladder on the top surface. To further retain a ladder on the top surface, the top surface has a slip resistant coating.

To prevent the device from sliding on a support surface, the bottom surface of the support member has a slip resistant tread. The tread has a plurality of ribs extending downward from the bottom surface of the support member. The ribs are oriented transversely to the lengthwise dimension of the support member, such that when the bottom surface of the support member rests on the support surface, the ribs tend to prevent the support member from sliding relative to the support surface. To prevent sliding on hard surfaces such as brick or concrete, the rubber grip tread preferably consists of a hard, substantially nonresilient rubber having a durometer greater than about 45 Shore A. The ribs are preferably linear and oriented perpendicular to the lengthwise dimension of the support member. In a preferred embodiment, the ribs are between about 1/16 to about 1/18 inch in height and are spaced about 1/8 inch to about 3/16 inch apart.

To prevent the device from sliding on soft surfaces such as grass or dirt, the device is additionally provided with a pair of retaining member bores adjacent the elevated rear end, along with a pair of retaining members sized to fit the retaining member bores. The retaining member bores pass through the top surface and the bottom surface of the support member. The retaining members have an enlarged head portion and an elongated spike portion extending from the head portion. The spike portion is sized and configured to extend entirely through the retaining member bores, such that a lower end of the spike may be selectively extended through the retaining member bore and into the support surface to thereby anchor the support member relative to the support surface.

To further enhance the safety properties provided by the retaining members, the retaining bores are angled downward toward the rear end of the support member, preferably at an angle between about 8 and about 12 degrees relative to vertical.

To prevent the retaining members from being lost when not in use, a pair of retaining member storage bores are preferably formed in the support member for storing the retaining members.

To assist a user in lifting the retaining members from the support surface, a finger hold is preferably formed in the elevated rear end of the support member for use in lifting the device from the support surface.

To assist in storing and transporting the device, the support member is preferably provided with a ladder hanger bore. The ladder holder bore is sized and configured to allow the device to be stored on the rung of a ladder.

To insure that the device is used in a proper manner when leveling a ladder, directional indicia are preferably imprinted on the support member. The indicia indicate which direction the support member is to be inserted under the ladder.

The foregoing and other objects, features, aspects and advantages of the invention will become more apparent from the following detailed description of the invention when considered in conjunction with the accompanying drawings.

BRIEF DESCRIPTION OF THE DRAWINGS

FIG. 1 is a side perspective view of one preferred embodiment of the invention.

FIG. 2 is a side-rear view of the embodiment of FIG. 1, featuring an exploded view of a preferred embodiment of a pair of retaining members.

PREFERRED EMBODIMENTS OF THE INVENTION

Figure 3:
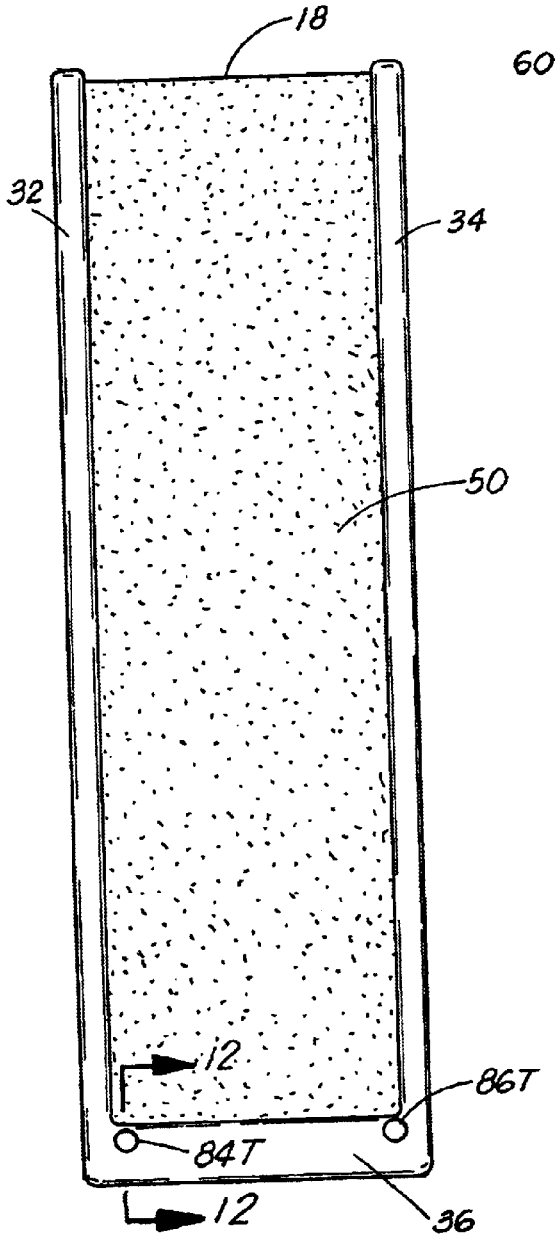
FIG. 3 is a top view of the embodiment of FIG. 1, featuring a slip resistant top surface.

In the following detailed description of the preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

FIG. 1 shows a side perspective view of the device 1 of the invention. The device 1 includes a wedge-shaped support member 10, a planar top surface 14, and a planar bottom surface 12. As shown in FIG. 1, the top surface 14 of the support member 10 tapers downward from an elevated rear end 16 to a narrow front vertex 18, such that an acute angle is formed between the top 14 and the bottom 12 surfaces. The acute angle is preferably between about 10 to 20 degrees, and more preferably between about 12 degrees and about 18 degrees. The rear end 16 is preferably perpendicular to the bottom surface 12. As shown in FIGS. 1 and 2, the support member 10 also has a pair of opposing length-wise side walls 22, 24. The side walls 22, 24 have a triangular configuration.

Figure 4:
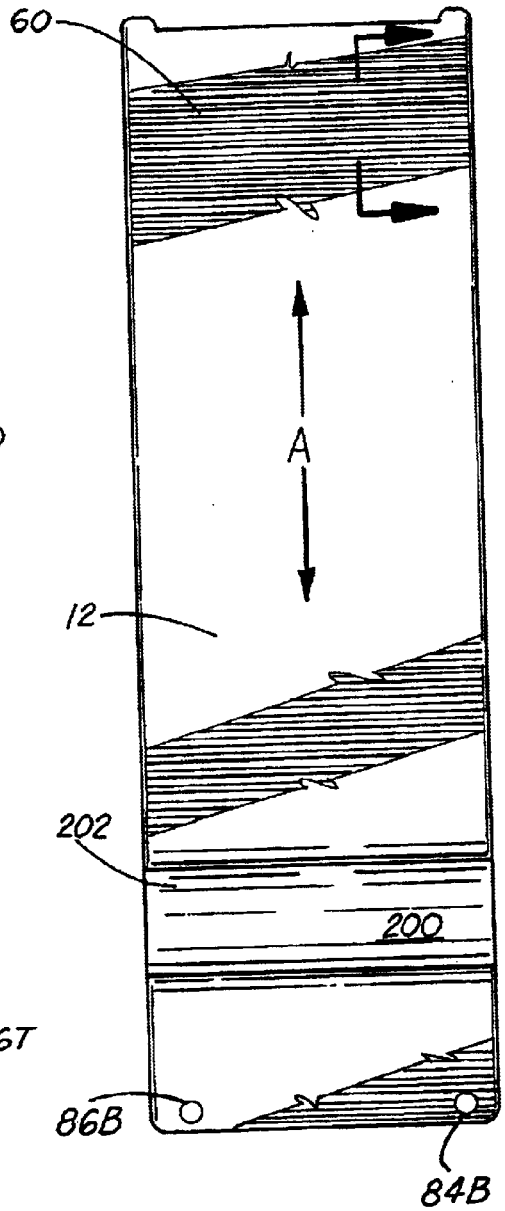
FIG. 4 is a bottom view of the embodiment of FIG. 1, featuring a slip resistant treaded bottom surface.
Figure 5:
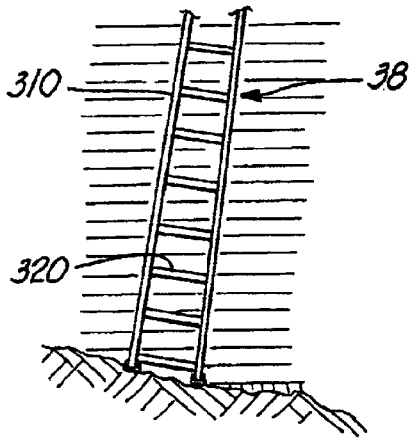
FIG. 5 shows a conventional extension ladder with the bottom end of the legs of the ladder resting on an unlevel or uneven support surface.
Figure 6:
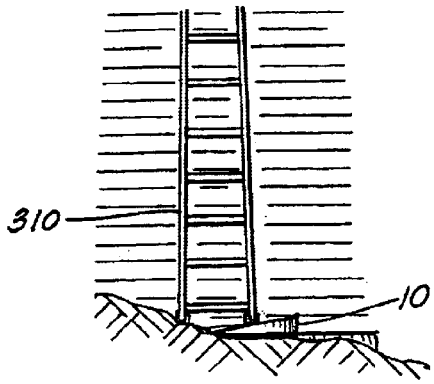
FIG. 6 shows the use of a prior art device, such as a brick or a stack of boards, to level the extension ladder of FIG. 5.

As indicated in FIG. 4, the device has a lengthwise dimension A. The support member 10 is preferably about 21 inches long in the lengthwise direction A, and is about 6¼ inches wide. These dimensions provide a wide platform, which enhances stability. The elevated rear end 16 is preferably about 5¼ inches in height, while the front vertex 18 is preferably about ⅛ inch in height. With these dimensions, the device 1 can be used to raise a leg 310 of a ladder 300 (FIGS. 5, 6) any height between about ⅛ inch and 5 inches. In sizing the device 1, there is a trade-off between length, height of the rear end 16, and the degree of slope. A heightened rear end 16 allows for a greater useful range of the device 1, but requires a longer upper surface 14 in order to provide a slope that is sufficiently gradual to allow for secure setting of the ladder 300 on the device 1. The preferred dimensions give the top surface 14 a gradual slope of about 15 degrees, and also provide a range of use that is sufficient to counteract the degree of slope typically encountered with non-level support surfaces.

Figure 14:
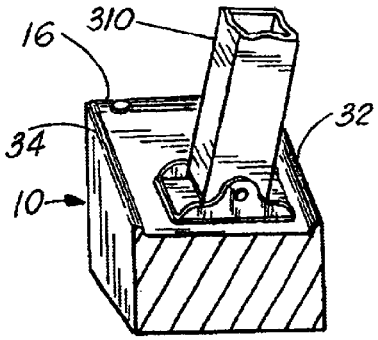
FIG. 14 is a front cross-section view of one preferred embodiment of the invention taken along 14-14 of FIG. 12, demonstrating the safety feature provided by the sidewalls of the device.

As shown in FIG. 1, a retaining rail 30 is positioned on the top surface 14. The retaining rail 30 assists in retaining the leg 310 of a ladder 300 on the top surface 14, which contributes to the safety of the device 1. In a preferred embodiment, the retaining rail 30 includes a rear rail member 36 and a pair of opposing side rail members 32, 34. The rear rail member 36 extends upward from the top surface 14 substantially along the elevated rear end 16. In a preferred embodiment, the rear rail member 36 is about 1⅜ inches wide and about ¼ to ½ inch high. The side rail members 32, 34 extend upward from the top surface 14 along opposing lengthwise sides of the top surface 14. As shown in FIG. 3, each side rail member 32, 34 extends downward from the elevated rear end 16 to the front vertex 18. The side rail members 32, 34 preferably match the height of the rear rail member 36. As shown in FIG. 3, the side rail members 32, 34 preferably extend downward from opposing ends of the rear rail member 36. As indicated in FIG. 14, the rear 36 and side rail 32, 34 members assist in keeping the ladder 300 in position on the support member 10, wherein the OSHA-approved foot 311 is disposed flatly on surface 50.

As shown in FIG. 3, the top surface 14 of the support member 10 has a slip resistant coating 50 thereon. The slip resistant coating 50 substantially covers the top surface 14 between the side 32, 34 and the rear 36 rail members. The slip resistant coating 50 increases the co-efficient of friction between the top surface 14 and the legs 310 of the ladder 300, which assists in keeping the ladder 300 in place for maximum safety. The slip resistant coating 50 is preferably a safety tread, such as the type conventionally applied to the surface of stairs, walkways and the like to prevent slippage. A preferred safety tread is 3M™ Safety-Walk™ tread, which is available from 3M. 3M™ Safety-Walk™ tread has a plurality of tiny, densely packed, and randomly arrayed peaks and valleys, which give it a texture similar to sandpaper. Unlike sandpaper, 3M™ Safety-Walk™ tread is a non-mineral product that is highly resistant to wear and tear. Safety treads are available in adhesive strips that can be readily cut to a desired dimension and then adhered to the top surface 14 of the support member 10.

Figure 7:
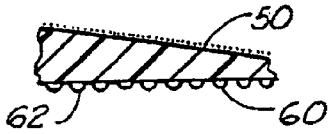
FIG. 7 shows a cross-section taken along 7-7 of FIG. 4, featuring details of the tread on the bottom surface of the support member of the invention, including a plurality of ribs.
Figure 8:
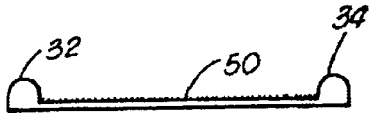
FIG. 8 is a side view of representative details of a slip resistant coating on the top surface of the support member.

As shown in FIG. 4, the bottom surface 12 of the support member 10 preferably has a slip resistant tread 60 thereon. As shown in FIG. 7, the tread 60 includes a plurality of ribs 62 that extend downward from the bottom surface 12 of the support member 10. The ribs 62 are oriented transversely to the lengthwise dimension A of the support member 10, such that when the bottom surface 12 of the support member 10 rests on the support surface, the ribs 62 tend to prevent the support member from sliding relative to the support surface. As shown in FIG. 4, the ribs 62 are preferably linear, and are preferably oriented perpendicular to the lengthwise dimension A of the support member 10. The ribs 62 are preferably spaced apart by about ⅛ inch to about 3/16 from peak-to-peak, and are preferably between about 1/16 to about ⅛ inch in height. Suitable rubber grip treads can be obtained from conventional lumber supply companies, such as Home Depot and Lowes. The treads are cut to a desired size and shape and are adhered to the bottom surface 12 of the support member.

The slip resistant tread is designed particularly for use on hard surfaces such as concrete or brick, where it is not possible to secure the support member 10 with retaining members 80, 82 (described below). In order to provide resistance and durability on hard surfaces, the tread 60 is preferably composed of a hard, substantially nonresilient rubber having a durometer of 45 Shore A or above, and preferably between about 45 Shore A and about 50 Shore A.

Figure 12:
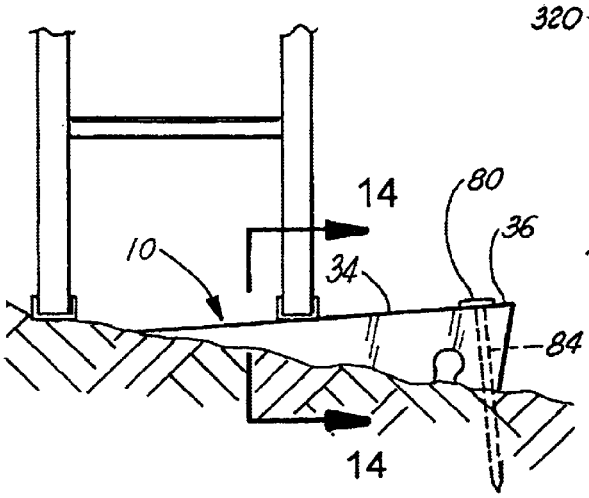
FIG. 12 is a side view cross-section taken along 12-12 of FIG. 3, demonstrating the safety feature provided by the retaining members.

As shown in FIGS. 2 and 12, the device 1 of the invention also preferably includes a retaining member system consisting of a pair of retaining members 80, 82 and a matching pair of retaining member bores 84, 86. The retaining member bores 84, 86 are preferably adjacent the elevated rear end 16 of the support member 10. As shown most clearly in FIGS. 3 and 4, each retaining member bore 84, 86 passes through the top surface 14 (see top bore openings 84T, 86T) and the bottom surface 12 (see bottom bore openings 84B, 86B) of the support member 10.

As shown in FIG. 2, the retaining members 80, 82 each have an enlarged head portion 81 and an elongated spike portion 83. The spike portion 83 extends from the head portion 81 in the manner of a nail. As shown in FIG. 12, the spike portion 83 is sized and configured to extend entirely through the retaining member bores 84, 86. The head portion 81 is sized larger than the diameter of the retaining member bores 84, 86. As shown in FIG. 12, a lower end of the spike 83 may be selectively extended through the retaining member bore 84, 86 and into the support surface to thereby anchor the support member 10 relative to the support surface. When used with a 5¼ inch rear end 16, the retaining members 80, 82 are preferably about 9 inches long.

As shown in FIG. 12, the retaining member bores 84, 86 are preferably angled downward toward the rear end 16 of the support member 10, preferably at between about 8 and about 12 degrees relative to vertical. With the bores 84, 86 angled in this manner, lateral forces applied to the support member 10 by the ladder 300 will tend to drive the retaining members 80,82 downward rather than laterally, thus securing the support member 10 and the ladder 300 in place.

Figure 15:
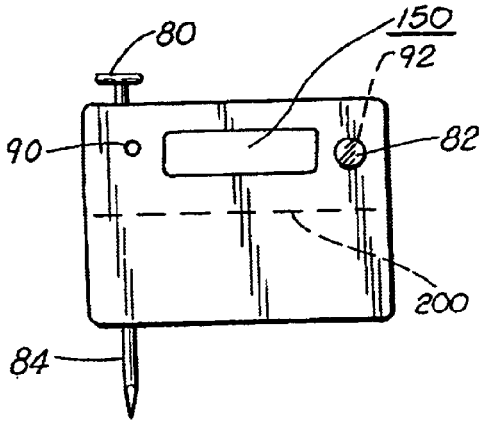
FIG. 15 is a rear view of one preferred embodiment of the invention, featuring storage bores for storing the retaining members.

When the device 1 is used on hard surfaces such as brink or concrete, the retaining members 80, 82 are normally not used. In order to store the retaining members 80, 82 and ensure that they do not become misplaced when the device 1 is used on hard surfaces, the support member 10 is preferably provided with a pair of retaining member storage bores 90, 92. As shown in FIG. 15, the retaining member storage bores 90, 92 are formed in the elevated rear end 16 of the support member 10. The storage bores 90, 92 are sized and configured to receive and securely envelop the elongated spike portions 83 of the retaining members 80, 82, such that the retaining members 80, 82 may be selectively and securely stored in the storage bores 90, 92.

When the retaining members 80, 82 are used to secure the device 1 on a soft surface, it may be difficult to remove the retaining members 80, 82 from the support surface. To assist in removing the retaining members 80, 82, the device 1 is preferably provided with a finger hold 150 formed in the elevated rear end 16, as shown in FIGS. 2 and 15. The finger hold 150 is configured to receive the tips of the fingers of a user, such that the user can lift upward and pull the device, along with the retaining members 80, 82, from the support surface.

Figure 9:
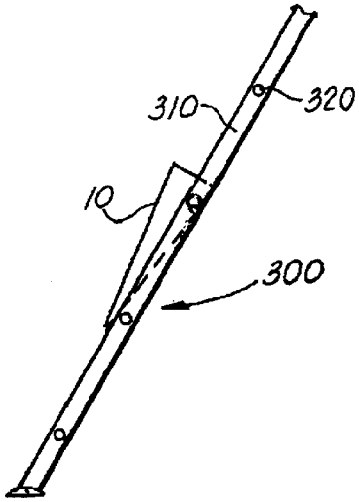
FIG. 9 shows the use of a ladder holder feature of the invention for conveniently attaching the device to a rung of a ladder during storage or transport.

As shown in FIGS. 1, 2, and 4, the support member 10 preferably has a ladder hanger bore 200. As shown in FIG. 9, the ladder hanger bore 200 is configured to removably latch onto the rung 320 of a ladder 300, such that the support member 10 can be selectively stored on the rung 320 during transport or storage of the ladder 300. As shown most clearly in FIG. 4, the ladder hanger bore 200 extends through the support member 10 substantially perpendicular to the lengthwise dimension A of the support member 10. As shown in FIG. 2, the ladder hanger bore 200 intersects the bottom surface 12 of the support member 10 to thereby form a rung opening 204. As shown in FIG. 9, the rung opening 204 is sized to receive a rung 320 of the ladder 300. As shown FIGS. 1 and 2, the ladder holder bore 200 preferably has a cylindrical sidewall 202. As shown in FIGS. 1 and 2, the ladder holder bore is positioned adjacent to the elevated rear end. In the embodiment illustrated, device 1 hangs on rung 320 as illustrated in FIG. 9, on the "underside of the ladder 300, so as to impede access to the rungs 320 as little as possible.

To further improve the safety of the device 1, indicia of direction 100 are preferably imprinted on the device 1. As shown in FIG. 1, the indicia 100 indicate which direction the support member 10 is to be inserted under the ladder, namely with the vertex end 18 pointing up the slope. As shown in FIG. 1, directional indicia 100 are preferably imprinted on at least a lengthwise sidewall 22, 24 of the support member. Directional indicia 100 may also be imprinted on the rear rail member 36.

Figure 10:
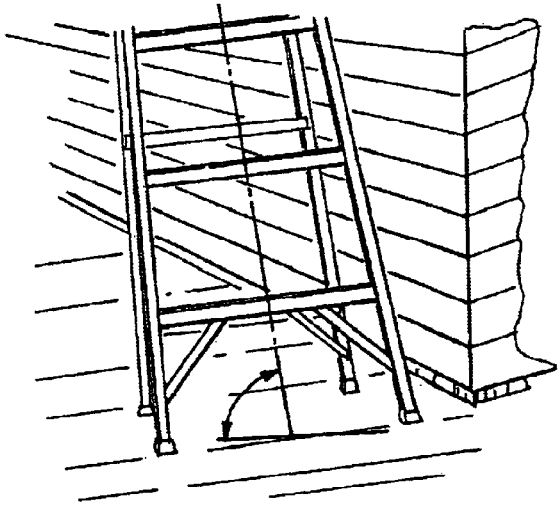
FIG. 10 shows a conventional step ladder with the legs of the step ladder resting on an nonlevel or uneven support surface.
Figure 11:
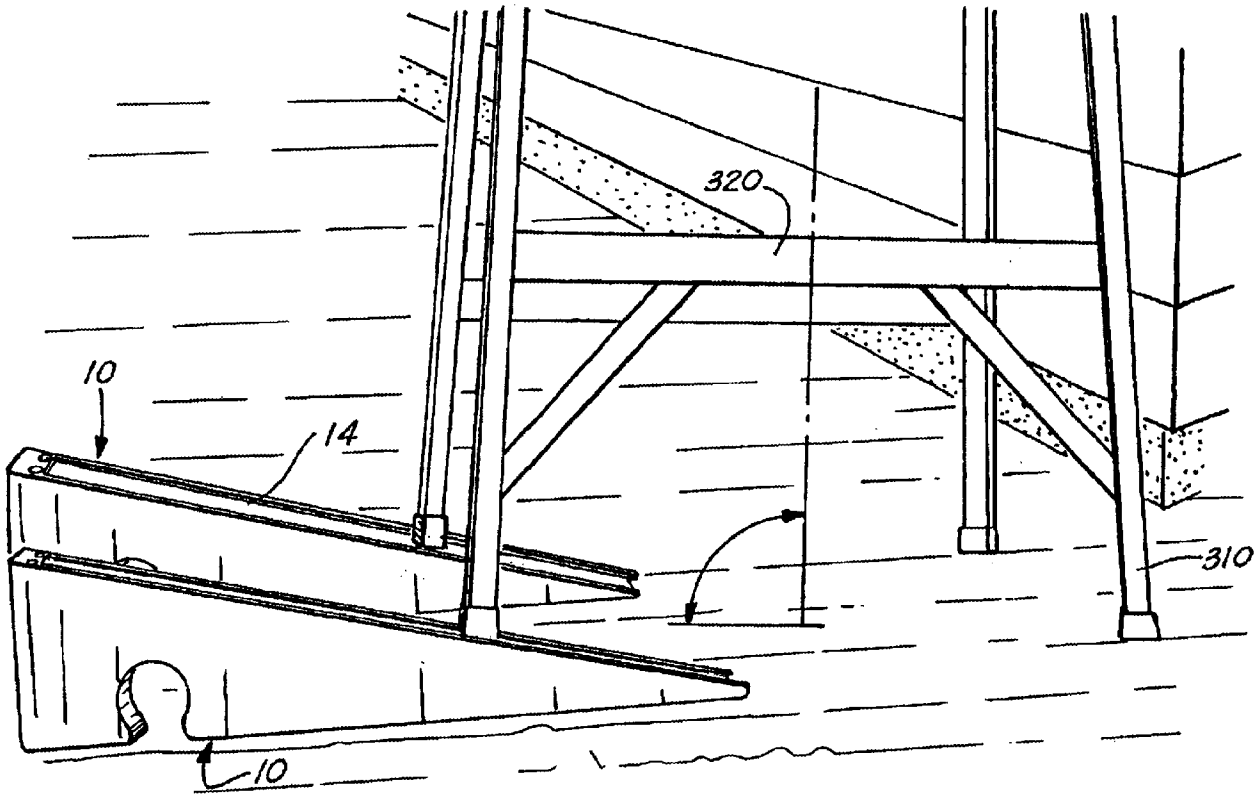
FIG. 11 shows the use of a pair of support members of the invention to level the step ladder of FIG. 10.
Figure 13:
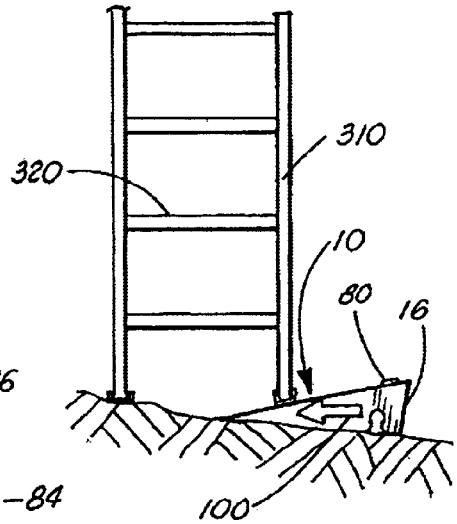
FIG. 13 is a side view of one preferred embodiment of the support member of the invention, showing use of the support member to level a ladder on an incline, and featuring indicia indicating orientation of the support member relative to the incline.

In operation, the device of the invention is used by inserting the narrow end vertex end 18 of the device 1 under the lower leg 310 of a ladder 300, and sliding the device 1 under the leg 310 until the rungs 320 of the ladder 300 are substantially horizontal. FIGS. 10 and 11 provide before and after views showing use of the device 1 to level a step ladder. FIG. 13 shows use of the device to level an extension ladder.

Although the present invention has been described in terms of specific embodiments, it is anticipated that alterations and modifications thereof will no doubt become apparent to those skilled in the art. It is therefore intended that the following claims be interpreted as covering all alterations and modifications that fall within the true spirit and scope of the invention.

What is claimed is:

1. A device for leveling a ladder relative to an unlevel or uneven support surface, the ladder including at least a pair of lengthwise support legs joined by a plurality of rungs, said device comprising:

a wedge-shaped support member having a lengthwise dimension, a planar top surface, and a planar bottom surface, said top surface of said support member tapering downward from an elevated rear end to a narrow front vertex to thereby form an acute angle between said top surface and said bottom surface, a rear rail member, said rear rail member extending upward from said top surface substantially along said elevated rear end, said support member having a pair of retaining member bores adjacent said elevated rear end, each said retaining member bore passing through said top surface and said bottom surface of said support member, and a pair of retaining members, each said retaining member having an enlarged head portion and an elongated spike portion extending from said head portion, said spike portion sized and configured to extend entirely through said retaining member bores, such that a lower end of each said spike may be selectively extended through said retaining member bore and into the support surface to thereby anchor said support member relative to the support surface, a pair of opposing side rail members, said side rail members extending upward from said top surface along opposing lengthwise sides of said top surface, each said side member extending downward from said elevated rear end to said front vertex, said top surface of said support member having a slip resistant coating thereon, said slip resistant coating substantially covering said top surface between said side and said rear rail members, said slip resistant coating increasing the co-efficient of friction between said top surface and the legs of the ladder, and said bottom surface of said support member having a slip resistant tread thereon, said tread including a plurality of ribs extending downward from said bottom surface of said support member, said ribs oriented transversely to said lengthwise dimension of said support member, whereby when said bottom surface of said support member rests on the support surface, said ribs tend to prevent said support member from sliding relative to the support surface.

2. The device of claim 1, wherein said slip resistant tread consists of a hard, substantially nonresilient rubber having a durometer greater than about 45 Shore A.

3. The device of claim 2, wherein said ribs are linear and are oriented perpendicularly to said lengthwise dimension of said support member.

4. The device of claim 3, wherein said ribs are between about 1/16 to about 1/18 inch in height.

5. The device of claim 4, wherein said ribs are spaced about 1/8 inch to about 3/16 inch apart.

6. The device of claim 1, wherein said slip resistant coating on said top surface is a safety tread.

7. The device of claim 1, wherein said retaining bores are angled downward toward said rear end of said support member.

8. The device of claim 7, wherein said retaining bores are angled downward at between about 8 and about 12 degrees relative to vertical.

9. The device of claim 1, further comprising said support member having a pair of retaining member storage bores formed in said elevated rear end, said storage bores sized and configured to receive and securely envelop said elongated spike portions of said retaining members such that said retaining members may be selectively and securely stored in said storage bores.

10. The device of claim 1, further comprising said elevated rear end of said support member having a finger hold formed therein, said finger hold configured to assist a user in lifting said support member to thereby remove said retaining members from the support surface.

11. A device for leveling a ladder relative to an unlevel or uneven support surface, the ladder including at least a pair of lengthwise support legs joined by a plurality of rungs, said device comprising:

a wedge-shaped support member having a lengthwise dimension, a planar top surface, and a planar bottom surface, said top surface of said support member tapering downward from an elevated rear end to a narrow front vertex to thereby form an acute angle between said top surface and said bottom surface, a rear rail member, said rear rail member extending upward from said top surface substantially alone said elevated rear end, said support member having a ladder hanger bore extending through said support member substantially perpendicular to said lengthwise dimension of said support member, said ladder hanger bore intersecting said bottom surface of said support member to thereby form a rung opening, said rung opening sized to receive a rung of the ladder, and said ladder hanger bore configured to removably latch onto the rung such that said support member may be selectively stored on the rung during transport or storage of the ladder, a pair of opposing side rail members, said side rail members extending upward from said top surface alone opposing lengthwise sides of said top surface, each said side member extending downward from said elevated rear end to said front vertex, said top surface of said support member having a slip resistant coating thereon, said slip resistant coating substantially covering said top surface between said side and said rear rail members, said slip resistant coating increasing the co-efficient of friction between said top surface and the legs of the ladder, and said bottom surface of said support member having a slip resistant tread thereon, said tread including a plurality of ribs extending downward from said bottom surface of said support member, said ribs oriented transversely to said lengthwise dimension of said support member, whereby when said bottom surface of said support member rests on the support surface, said ribs tend to prevent said support member from sliding relative to the support surface.

12. The device of claim 11, wherein said ladder holder bore is cylindrical.

13. The device of claim 11, wherein said ladder holder bore is adjacent said elevated rear end.

14. The device of claim 1, further comprising directional indicia imprinted on said support member, said indicia indicating which direction said support member is to be inserted under the ladder.

15. A device for leveling a ladder relative to an unlevel or uneven support surface, the ladder including at least a pair of lengthwise support legs joined by a plurality of rungs, said device comprising:

a wedge-shaped support member having a lengthwise dimension, a planar top surface, and a planar bottom surface, said top surface of said support member tapering downward from an elevated rear end to a narrow front vertex to thereby form an acute angle between said top surface and said bottom surface, said top surface of said support member having a slip resistant coating thereon, said slip resistant coating substantially covering said top surface, said slip resistant coating increasing the co-efficient of friction between said top surface and the legs of the ladder, said bottom surface of said support member having a slip resistant tread thereon, said tread including a plurality of ribs extending downward from said bottom surface of said support member, said ribs oriented transversely to said lengthwise dimension of said support member, whereby when said bottom surface of said support member rests on the support surface, said ribs tend to prevent said support member from sliding relative to the support surface, said support member having a pair of retaining member bores adjacent said elevated rear end, each said retaining member bore passing through said top surface and said bottom surface of said support member, and a pair if retaining members, each said retaining member having an enlarged head portion and an elongated spike portion extending from said head portion, said spike portion sized and configured to extend entirely through said retaining member bores, such that a lower end of each said spike may be selectively extended through said retaining member bore and into the support surface to thereby anchor said support member relative to the support surface.

16. The device of claim 15, further comprising said support member having a pair of retaining member storage bores formed in said elevated rear end, said storage bores sized and configured to receive and securely envelop said elongated spike portions of said retaining members such that said retaining members may be selectively and securely stored in said storage bores.

17. The device of claim 16, further comprising said elevated rear end of said support member having a finger hold formed therein, said finger hold configured to assist a user in lifting said support member to thereby remove said retaining members from the support surface.

18. The device of claim 15, further comprising said support member having a ladder hanger bore extending through said support member substantially perpendicular to said lengthwise dimension of said support member, said ladder hanger bore intersecting said bottom surface of said support member to thereby form a rung opening, said rung opening sized to receive a rung of the ladder, and said ladder hanger bore configured to removably latch onto the rung such that said support member may be selectively stored on the rung during transport or storage of the ladder.

19. The device of claim 15, further comprising a rear rail member, said rear rail member extending upward from said top surface substantially along said elevated rear end, and a pair of opposing side rail members, said side rail members extending upward from said top surface along opposing lengthwise sides of said top surface, each said side member extending downward from said elevated rear end to said front vertex.

20. The device of claim 19, wherein said slip resistant tread consists of a hard, substantially nonresilient rubber having a durometer greater than about 45 Shore A.

* * * * *